US005170176A

United States Patent [19]

Yasunaga et al.

[11] Patent Number: 5,170,176

[45] Date of Patent: Dec. 8, 1992

[54] QUADRIFILAR HELIX ANTENNA

[75] Inventors: Masayuki Yasunaga; Takayasu Shiokawa, both of Tokyo, Japan

[73] Assignee: Kokusai Denshin Denwa Co., Ltd., Tokyo, Japan

[21] Appl. No.: 659,657

[22] Filed: Feb. 25, 1991

[30] Foreign Application Priority Data

Feb. 27, 1990 [JP] Japan ..... 2-44627

[51] Int. Cl.[5] ..... H01Q 1/36

[52] U.S. Cl. ..... 343/895; 343/796

[58] Field of Search ..... 343/895, 796

[56] References Cited

U.S. PATENT DOCUMENTS 4,396,920 8/1983 Grimberg et al. ..... 343/752

4,658,262 4/1987 Duhamel ..... 343/895

FOREIGN PATENT DOCUMENTS 0241921 10/1987 European Pat. Off. .

OTHER PUBLICATIONS

Kilgus, "Resonant Quadrifilar Helix Design" The Microwave Journal, Dec. 1970, pp. 49-54.

"Resonant Quadrafilar Helix", Kilgus et al, IEEE Transactions On Antennas And Propagation, May, 1969, pp. 349-351.

"Shaped-Conical Radiation Pattern Performance of the Backfire Quadrifilar Helix", Kilgus, IEEE Transactions On Antennas And Propagation, May, 1975, pp. 392-397.

"Multielement, Fractional Turn Helices", Kilgus, IEEE Transactions On Antennas And Propagation, Jul., 1968, pp. 499-500.

*Primary Examiner*—Rolf Hille

*Assistant Examiner*—Hoanganh Le

*Attorney, Agent, or Firm*—Nikaido, Marmelstein, Murray & Oram

[57] ABSTRACT

A quadrifilar helix antenna according to the present invention incorporates four helix conductors wound around an axis in the same winding direction. Each of the helix conductors has a linear conductor which is parallel to its axis at either end or both ends of the helix conductor. The present antenna reduces the effect of multipath fading due to sea-surface reflection in mobile satellite communications.

11 Claims, 6 Drawing Sheets

QUADRIFILAR HELIX ANTENNA

BACKGROUND OF THE INVENTION

The present invention relates to a small mobile antenna in a mobile satellite communication system. The mobile satellite communication system can provide a high quality communication service in a wide area. A communication service for ships is now available all over the world by using the INMALSAT system. Mobile communication systems for aircraft, and/or land mobile stations have also now been developed. In a mobile satellite communication system, a small antenna which has half sphere coverage does not need to track a desired satellite, and is considered promising for making an antenna small. Further, a circularly polarized radio wave is used for a mobile satellite communication system, and a mobile antenna with a wide angle, and excellent axis-ratio characteristics has been required. With this in mind, a quadrifilar helix antenna which has four coils is considered to be one of the candidates for a small mobile antenna. A prior quadrifilar helix antenna, for example, is shown in "Resonant Quadrafilar Helix" by C. C. Kilgus in IEEE Trans. vol.AP-17, May 1969.

FIG. 7 shows a structure of a prior quadrifilar helix antenna. In the figure, the numeral 41 is a feed circuit, 42 through 45 are feed lines, 46 through 49 are helix conductors. The helix conductors 47, 48 and 49 are fed with the phase differences 90°, 180° and 270°, respectively, in comparison with that of the helix conductor 46, and the antenna radiates circularly polarized waves. The shape of the antenna is defined by its pitch distance, the number of helix turns and the radius of the helix conductors. One example of each of those parameters for achieving an almost half sphere beam are 1 λ of pitch the distance, 0.5 turn, and 0.1 λ of the radius of helix conductors, where λ is the wavelength to be used.

FIG. 8 shows the radiation characteristics of the prior quadrifilar helix antenna having said parameters. In FIG. 8, $\theta$ is the angle between a observation point and a helix axis; a solid line and a dotted line show the radiation pattern for a co-circular polarization, and that for the anti-circular polarization, respectively.

The prior quadrifilar helix antenna has a wide beam, and excellent axis-ratio characteristics in a wide area as shown in FIG. 8.

However, a prior quadrifilar helix antenna has the disadvantages that the value of the parameters for the desired characteristics are severely restricted, and it is impossible to provide a smaller-sized antenna.

Further, in a mobile satellite communication system which includes a ship and/or an aircraft, a mobile antenna receives not only a direct wave from a satellite, but also reflected waves by the sea-surface. The direct wave and reflected waves interfere with each other, and the receive level is subject to fading which is called a multipath fading due to sea-surface reflection (denoted by "multipath fading" hereafter).

In a mobile satellite communication system, a power margin is provided so that communication is possible with a defined percent of the time even under the decreased level resulting from the multipath fading. When the power margin is large, a satellite must transmit with high power. The wider an antenna beam and the lower an elevation angle of a satellite are, the larger the effect of multipath fading due to sea-surface reflection. Therefore, it is desirous that the mobile antenna is not affected by multipath fading.

By the way, when a circularly polarized wave is reflected by the sea-surface, the reflected wave has an elliptical polarization whose major axis is almost parallel to the sea-surface. Therefore, from the view point of the rejection of reflected waves, it is preferable that the polarization characteristics of the mobile antenna in the direction of the reflected waves is orthogonal to those characteristics of the reflected waves. In other words, it is preferable that the major axis of an elliptical polarization is directed as vertical as possible.

However, a prior quadrifilar helix antenna has the elliptical polarization in which the major axis is directed in an almost horizontal direction, and therefore, it tends to be affected by the multipath fading. This is explained in accordance with FIG. 9, which shows the polarization characteristics of the sea-surface reflection waves with the elevation angle of 5 degrees, and those of the antenna's sea-surface reflection direction (5 degrees under horizon) of a prior quadrifilar helix antenna. In the figure, the numeral 61 is the sea-surface, 62 is the polarization characteristic of the sea-surface reflection waves, and 63 is polarization characteristics of a prior quadrifilar helix antenna.

It should be noted in FIG. 9 that a prior quadrifilar helix antenna has the elliptical polarization whose major axis is essentially parallel to the sea-surface. Therefore, a prior antenna receives a significant amount of the sea-surface reflection waves, and is subsequently affected by the multipath fading.

SUMMARY OF THE INVENTION

It is an object of the present invention to overcome the disadvantages and limitations of the prior quadrifilar helix antenna by providing a new and improved quadrifilar helix antenna.

It is also an object of the present invention to provide a quadrifilar helix antenna which reduces the effect of multipath fading, and is smaller in size than the prior quadrifilar helix antenna.

The above and other objects are attained by a quadrifilar helix antenna comprising a feed circuit located on a z-axis of xyz rectangular coordinates system; four feed lines extending from said feed circuit so that those feed lines are perpendicular to one another and are parallel to the xy plane; four helix conductors of which their center axis coincides with the z-axis, and all the helix conductors have the same winding direction; and four linear conductors at either end or both ends of each of said helix conductors so that those linear conductors are parallel to the z-axis, and all the linear conductors have the same length.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Embodiment 1

Figure 1:
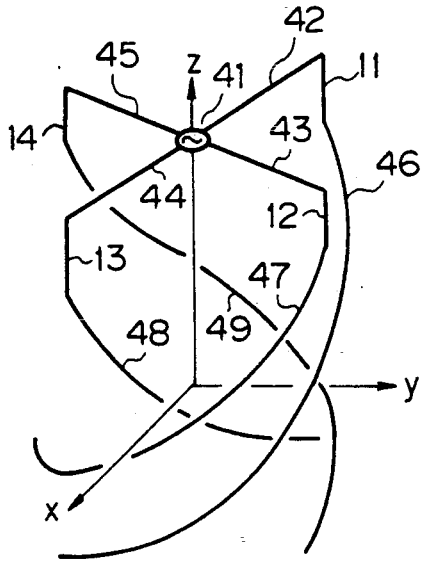
FIG. 1 shows a structure of a quadrifilar helix antenna according to the present invention.

FIG. 1 shows the quadrifilar helix antenna according to the present invention. In the figure, the quadrifilar helix antenna has the feed circuit 41 which is located on the z-axis of the xyz rectangular coordinates system, four feed lines 42 through 45 extending from said feed circuit 41 so that those feed lines are perpendicular to one another and are parallel to the xy plane, four helix conductors 46 through 49 attached to one end of each of said feed lines so that the center axis of the helix coincides with the z-axis, and all the helixes are wound in the same direction, and four linear conductors 11 through 14 inserted between each of said feed lines 42–45 and each of said helix conductors 46–49 so that those linear conductors are parallel to the z-axis and all the linear conductors have the same length.

Figure 10:
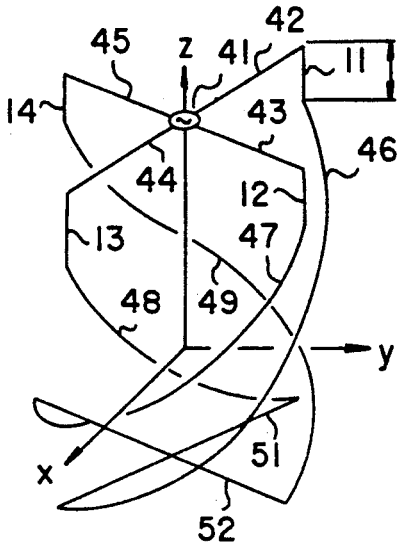
FIG. 10 shows a structure of a quadrifilar helix antenna according to FIG. 1 incorporating linear short-circuiting conductors.

The opposite ends of each helix conductors, which have no linear conductor attached, 46–49, may be open as shown in FIG. 1. Alternatively, each of said ends may be connected with one another by using linear conductors 51, 52 which are perpendicular to one another as shown in FIG. 10.

Figure 2:
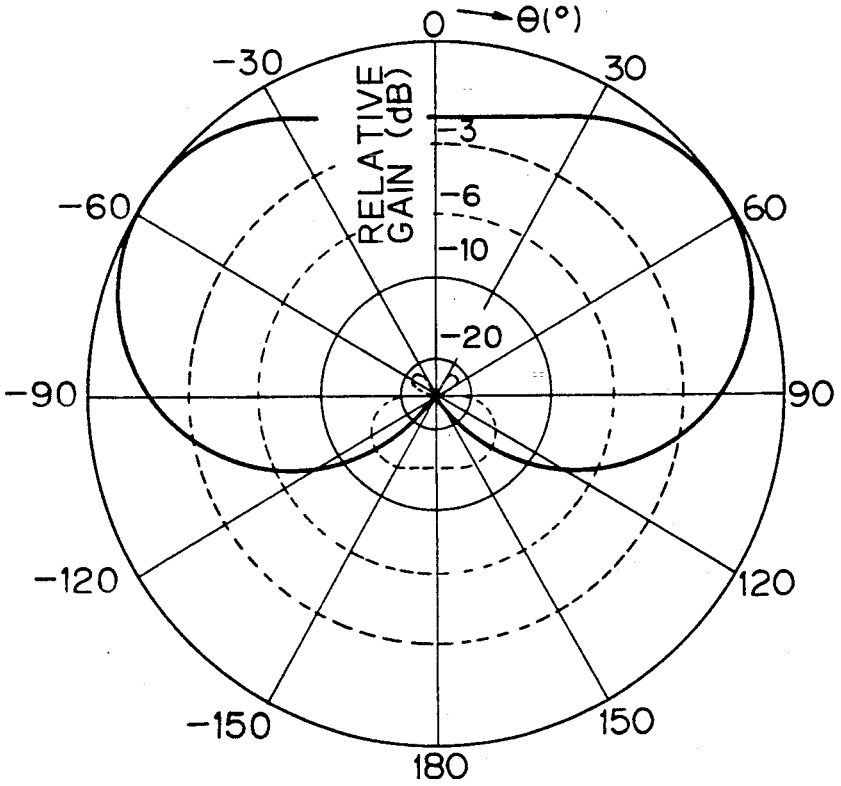
FIG. 2 shows the radiation pattern of a quadrifilar helix antenna of FIG. 1.

FIG. 2 shows the radiation pattern of the antenna of FIG. 1. The parameters for FIG. 2 include that the length of the linear conductors 11–14 is 0.04 λ, the pitch length of the helix conductors 46–49 is 1 λ, the number of turns of each helix conductor 46–49 is 0.5, and the radius of the helix is 0.04 λ, where λ is the wavelength. It can be seen from FIG. 2 that he quadrifilar helix antenna with the above parameters has the wide beam, and excellent axis-ratio characteristics as compared with those of FIG. 8.

Figure 8:
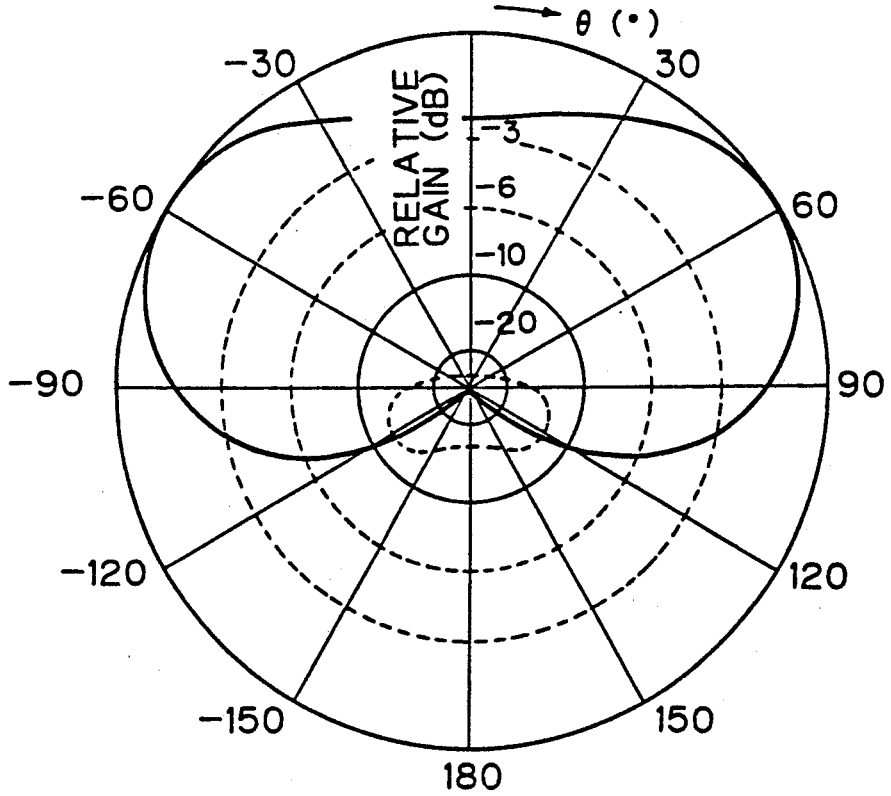
Fig. 8 PRIOR ART
FIG. 8 shows the radiation pattern of the prior antenna of FIG. 7.
Figure 9:
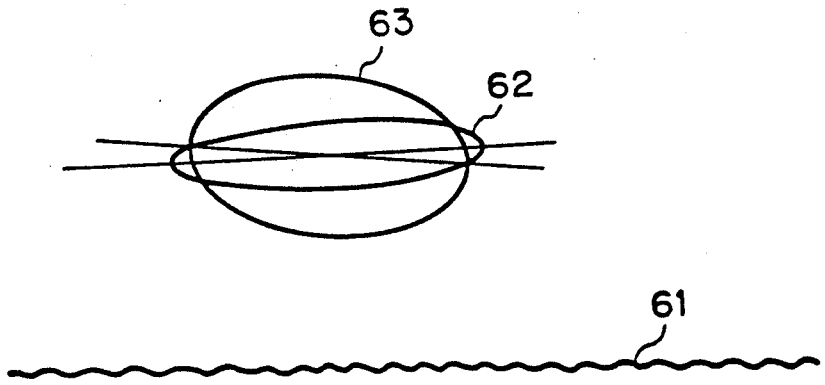
Fig. 9 PRIOR ART
FIG. 9 shows polarization characteristics of the sea-surface reflected waves, and the antenna in the sea-surface reflection direction in the prior art.

It should be also noted that the radius of the helix in FIG. 1 is only less than almost half of that of FIG. 8.

The preferable parameter ranges of the antenna for providing the excellent characteristics in terms of the radiation pattern and axial ratio are 0.02–0.06 λ for the length of the linear conductors 11–14, 0.9–1.1λ for the pitch length of the helix conductors 46–49, and 0.4–0.6 for the number of turns of the helix and 0.02–0.06 λ for the radius of the helix.

Embodiment 2

Figure 3:
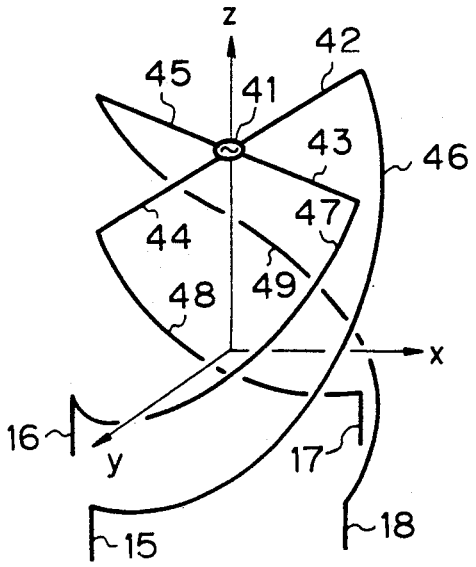
FIG. 3 shows a structure of the second embodiment of the quadrifilar helix antenna according to the present invention.

FIG. 3 shows the structure of the second embodiment of the present invention quadrifilar helix antenna. In the figure, the quadrifilar helix antenna has the feed circuit 41 located on the z-axis of the xyz rectangular coordinates system, four feed lines 42 through 45 extending from said feed circuit 41 so that those feed lines are perpendicular to one another and are parallel to the xy plane, four helix conductors 46 through 49 attached to one end of each of the related feed lines so that the center axis of the helix coincides with the z-axis, and the winding direction of all the helixes is same, and four linear conductors 15 through 18 attached to one end of each of the helix conductors so that those linear conductors are parallel to the z-axis, and all the helix conductors have the same length.

Figure 11:
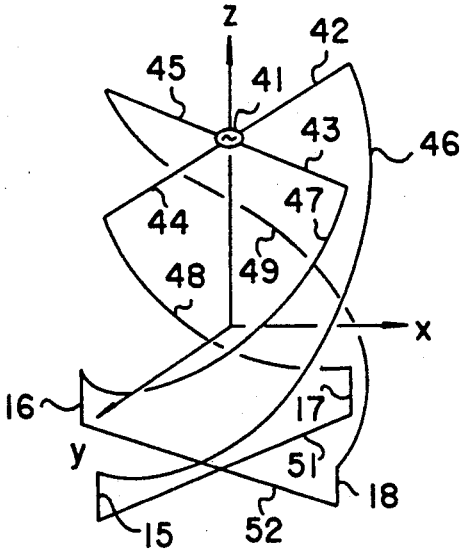
FIG. 11 shows a structure of a quadrifilar helix antenna according to FIG. 3 incorporating linear short-circuiting conductors.

An opposite end of the linear conductors 15–18 at which no helix conductors are attached may be open as shown in FIG. 3. Alternatively, said ends may be short-circuited by using linear conductors 51, 52 perpendicular to one another as shown in FIG. 11.

One example of the parameters which provide an excellent radiation pattern and axis-ratio characteristics is 0.04 λ for the length of the linear conductors 11–14, 1 λ for the pitch length of the helix conductors 46–49, 0.5 for the number of turns of the helix and 0.04 λ for the radius of the helix.

Figure 4:
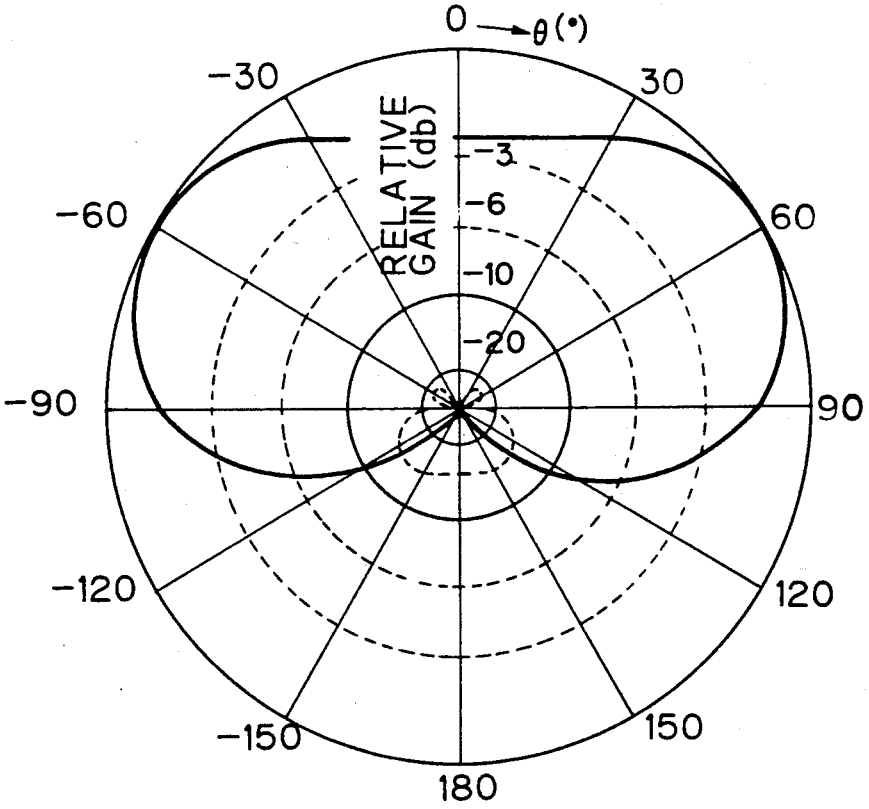
FIG. 4 shows the radiation pattern of the quadrifilar helix antenna of FIG. 3.

FIG. 4 shows the radiation pattern of the antenna which has the above parameters. It should be noted in FIG. 4 that the present antenna has a wide beam and good axis-ratio characteristics as compared with these FIG. 8. Since the radius of the present antenna is almost less than half that of the prior art of FIG. 8, the present invention may provide the smaller antenna.

The preferable ranges of the antenna parameters to provide the excellent characteristics in terms of radiation pattern and axial ratio are 0.02–0.06 λ for the length of the linear conductors 11–14, 0.9–1.1 λ for the pitch length of the helix conductors 46–49, and 0.4–0.6 for the number of turns of the helix and 0.02–0.06 λ for the radius of the helix.

Embodiment 3

Figure 5:
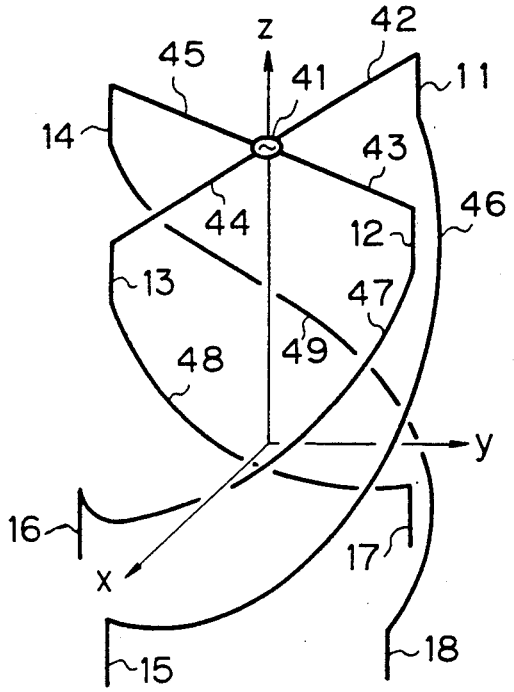
FIG. 5 shows a structure of the third embodiment of a quadrifilar helix antenna according to the present invention.

FIG. 5 shows the third embodiment of the present helix antenna. In the figure, the antenna has the feed circuit 41 located on the z-axis of the xyz rectangular coordinates system, four feed lines 42–45 extending from said feed circuit 41 so that those feed lines are perpendicular to one another and are parallel to the xy plane, four helix conductors 46–49 so that the center axis coincides with the z-axis with all the helix conductors having the same winding direction. The first four linear conductors 11 through 14 are inserted between the feed lines 42–45, and the helix conductors 46–49 so that those linear conductors are parallel to the z-axis and all the linear conductors have the same length. The second four linear conductors 15 through 18 are attached to the other end of the helix conductors so that those linear conductors are parallel to the z-axis, and all have the same length.

Figure 12:
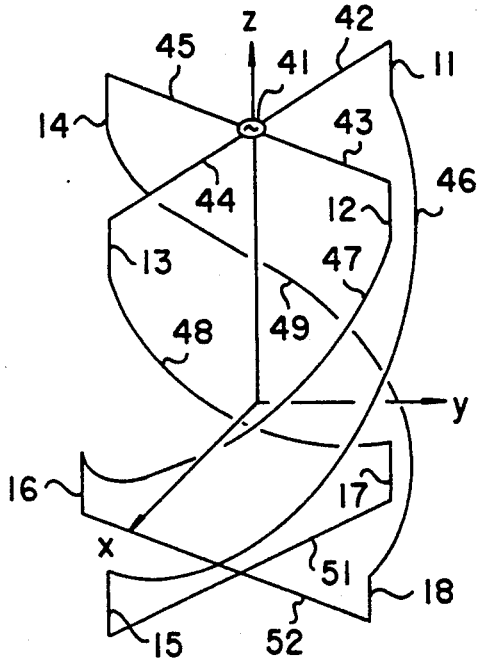
FIG. 12 shows a structure of a quadrifilar helix antenna according to FIG. 5 incorporating linear short-circuiting conductors.

An opposite end of the linear conductors 15–18 at which no helix conductors are attached, may be open as shown in FIG. 5. Alternatively, said ends may be short-circuited by using linear conductors 51, 52 perpendicular to each other as shown in FIG. 12.

Figure 7:
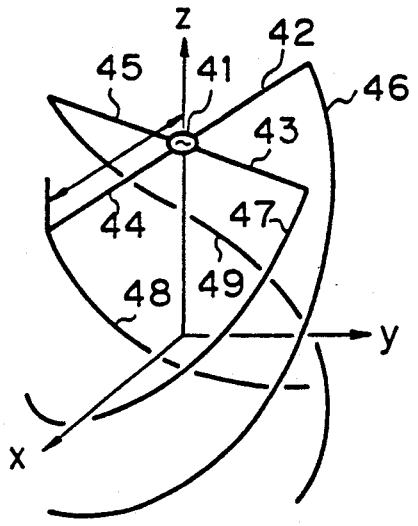
Fig. 7 PRIOR ART
FIG. 7 shows a prior quadrifilar helix antenna.

The structure of FIG. 5 can also provide the wide beam and the small size of the antenna which has less radius of the helix than that of the prior art shown in FIG. 7.

The ranges of the parameters of the case of FIG. 5 to provide excellent characteristics in terms of radiation pattern and axial ratio are 0.02–0.06 λ for the length of the first linear conductors 11–14, 0.02–0.06 λ of the length of the second linear conductors 15–18, 0.9–1.1 λ for the pitch length of the helix conductors 46–49, 0.4–0.6 for the number of turns of the helix and 0.02–0.06 λ for the radius of the helix, where λ is the wavelength. It should be appreciated that the embodiment of FIG. 5 has more freedom in determining the parameters to provide excellent characteristics as compared with those of FIG. 1 and FIG. 3.

Figure 6:
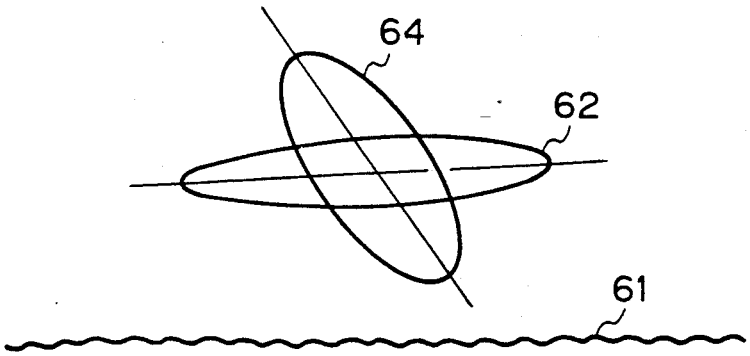
FIG. 6 shows polarization characteristics of the sea-surface reflection waves, and the quadrifilar helix antenna of FIG. 5 in the sea-surface reflection direction.

FIG. 6 shows the polarization characteristics of the sea-surface reflection wave and the present helix antenna which has the parameters of 0.04 λ for the length of the first linear conductors 11–14, 0.04 λ for the second length of the linear conductors 15–18, 1 λ for the pitch length of the helix conductors 46–49, 0.5 for the number of turns of the helix, and 0.06 λ for the radius of the helix. The numeral 64 shows the polarization characteristics in the sea-surface reflection direction (5 degrees below the horizon) of the present helix antenna. The major axis of the elliptical polarization of the present helix antenna in the sea-surface reflection direction (5–10 degrees below the horizon) is inclined by about 40 degree from the vertical polarization direction (50 degree from the sea-surface.)

It should be appreciated in FIG. 6 that the direction of the major axis of the elliptical polarization of the present antenna has a large angle from that of the sea-surface reflection waves. Therefore, the multipath fading is expected to be reduced considerably. In our theoretical calculation for the elevation angle of 5 degrees to the satellite, a fading depth of about 10 dB in the case of a prior antenna is observed, while that of about 7.5 dB in the case of the present antennas. Therefore, the amount of the fading depth is improved by 2.5 dB (about half for the required power) when the present invention is employed.

As mentioned above in detail, according to the present invention, the present antenna may have a wider range of parameters to provide the excellent antenna characteristics as compared with a prior antenna. Thus, a large design freedom is obtained. The size of the present antenna is smaller than that of the prior art antenna. Furthermore, the multipath fading which becomes a serious problem at a low elevation angle in the mobile satellite communication can be significantly reduced.

It should be appreciated in the above embodiments, that a feed line, a linear conductor and a helix conductor may be either integral and can be made of a single conductive wire, or those members can be made of separate conductive wires which are coupled with one another.

From the foregoing it will now be apparent that a new and improved quadrifilar helix antenna has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A quadrifilar helix antenna comprising:

a feed circuit located on a z-axis of an xyz rectangular coordinates system;

four feed lines extending from said feed circuit so that said feed lines are perpendicular to one another and are parallel to an xy plane;

four linear conductors each having a top and a bottom end, a top end of each said four linear conductors being connected to a corresponding feed line and positioned such that said linear conductors are parallel to the z-axis, said linear conductors all having the same length; and four helix conductors each having a first end and a second end so that the first end of each of said four helix conductors is attached to a bottom end of a corresponding linear conductor among said four linear conductors, said four helix conductors being positioned such that center axes of said four helix conductors are defined along the z-axis, said four helix conductors all having the same winding direction, wherein a length of each of said linear conductors is 0.02–0.06 λ, a pitch length of each of said helix conductors is 0.9–1.1 λ, a number of turns of a helix of each of said helix conductors is 0.4–0.6 and the radius of the helix is 0.02–0.06 λ, where λ is a wavelength, and a corresponding feed line, linear conductor and helix conductor are integral and made from a single wire.

2. A quadrifilar helix antenna according to claim 1, wherein an each second end of said helix conductors is open.

3. A quadrifilar helix antenna according to claim 1, wherein the second ends of said helix conductors are short-circuited to one another by linear conductors.

4. A quadrifilar helix antenna comprising:

a feed circuit located on a z-axis of an xyz rectangular coordinates system;

four conductive feed lines extending from said feed circuit so that said feed lines are perpendicular to one another and are parallel to an xy plane;

four helix conductors having a first end and a second end so that the first end of each of said four helix conductors is attached to one of a corresponding feed line, said four helix conductors being positioned such that center axes of said four helix conductors are all defined along the z-axis, said four helix conductors all having the same winding direction; and four linear conductors each attached to the second end of a corresponding helix conductor among said four helix conductors so that said linear conductors are parallel to the z-axis, said linear conductors all having the same length.

5. A quadrifilar helix antenna according to claim 4, wherein a length of each of said linear conductors is 0.02–0.06 λ, a pitch length of each of said helix conductors is 0.9–1.1 λ, a number of turns of a helix of each of said helix conductor is 0.4–0.6, and the radius of the helix is 0.02–0.06 λ, where λ is a wavelength.

6. A quadrifilar helix antenna according to claim 4, wherein the bottom ends of said linear conductors are open.

7. A quadrifilar helix antenna according to claim 4, wherein the bottom ends of said linear conductors are short-circuited to one another by linear conductors.

8. A quadrifilar helix antenna comprising:

a feed circuit located on a z-axis of an xyz rectangular coordinates system;

four feed lines extending from said feed circuit so that those feed lines are perpendicular to one another and are parallel to xy plane;

four first linear conductors each having a top and a bottom end, a top end of each said four linear conductors being connected to a corresponding feed line and positioned such that said linear conductors are parallel to the z-axis, said linear conductors all having the same length;

four helix conductors each having a first end and a second end so that center axes of each helix conductor among said four helix conductors are defined along the z-axis, the bottom end of each of said first linear conductors being connected to the first end of a corresponding helix conductor among the said four helix conductors, said helix conductors all having the same winding direction; and four second linear conductors, each attached to the second end of a corresponding helix conductor among said four helix conductors and positioned so that said second linear conductors are parallel to the z-axis said four second linear conductors all having the same length.

9. A quadrifilar helix antenna according to claim 8, wherein a length of each of said first linear conductors is 0.02–0.06 λ, a length of each of said second linear conductors is 0.02–0.06 λ, a pitch length of each of said helix conductors is 0.9–1.1 λ, a number of turns of a helix of each of said helix conductor is 0.4–0.6, and the radius of the helix is 0.02–0.06 80 , where λ is a wavelength.

10. A quadrifilar helix antenna according to claim 8, wherein the bottom ends of said second linear conductors are open.

11. A quadrifilar helix antenna according to claim 8, wherein the bottom ends of said second linear conductors are short-circuited to one another by linear conductors.

* * * * *